US007185962B2

(12) United States Patent
Takahashi et al.

(10) Patent No.: US 7,185,962 B2
(45) Date of Patent: Mar. 6, 2007

(54) INK JET APPARATUS AND INK JET PRINT METHOD HAVING A PLURALITY OF DOUBLE-SIDED PRINTING MODES

(75) Inventors: Kiichiro Takahashi, Kanagawa (JP); Minoru Teshigawara, Kanagawa (JP); Tetsuya Edamura, Kanagawa (JP); Satoshi Seki, Kanagawa (JP); Naomi Oshio, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 10/909,283

(22) Filed: Aug. 3, 2004

(65) Prior Publication Data

US 2005/0030333 A1 Feb. 10, 2005

(30) Foreign Application Priority Data

Aug. 8, 2003 (JP) ..... 2003-290734

(51) Int. Cl.
*B41J 29/38* (2006.01)

(52) U.S. Cl. ..... 347/14; 347/16

(58) Field of Classification Search ..... 347/14, 347/16

See application file for complete search history.

(56) References Cited

U.S. PATENT DOCUMENTS 5,988,906 A 11/1999 Arcaro et al.
5,992,971 A 11/1999 Takahashi et al.
6,134,417 A * 10/2000 Fukasawa ..... 399/367
6,167,231 A * 12/2000 Blackman et al. ..... 399/364
6,260,938 B1 7/2001 Ohtsuka et al.
6,293,716 B1 * 9/2001 Driggers et al. ..... 400/578
6,332,068 B2 * 12/2001 Blackman et al. ..... 399/364
6,543,872 B2 4/2003 Ohtsuka et al.
2003/0094108 A1 * 5/2003 Shiki ..... 101/171
2004/0095406 A1 * 5/2004 Uchida ..... 347/16
2004/0100516 A1 * 5/2004 Nagoshi ..... 347/14
2004/0179053 A1 * 9/2004 Itoh ..... 347/16
2005/0012764 A1 * 1/2005 Kawakami ..... 347/5
2005/0024401 A1 * 2/2005 Oshio et al. ..... 347/9

FOREIGN PATENT DOCUMENTS

JP 2000-191204 7/2000

* cited by examiner

*Primary Examiner*—Stephen Meier
*Assistant Examiner*—Rene Garcia, Jr.
(74) *Attorney, Agent, or Firm*—Fitzpatrick, Cella, Harper & Scinto

(57) ABSTRACT

An ink jet print apparatus having a plurality of double-sided printing modes (e.g., automatic double-sided printing mode and manual double-sided printing mode) produces a sufficient image quality whichever mode is executed. For this purpose, image data to be printed is converted into print image data usable by the printing apparatus in a way that matches a selected one of multiple print medium transport paths. This minimizes a curling problem due to variations in transport processes, image quality variations caused by an ink fixing problem and adverse effects on the printing apparatus and ensures a stable printing whichever transport path is used for printing.

10 Claims, 7 Drawing Sheets

FIG.6A

PRINT MEDIUM 1

| | PRIMARY COLOR | | | | SECONDARY COLOR | TERTIARY COLOR |
|---|---|---|---|---|---|---|
| | Bk | Cyan | Magenta | Yellow | | |
| NORMAL PRINTING | 100 % | 100 % | 100 % | 100 % | 200 % | 300 % |
| MANUAL DOUBLE-SIDED PRINTING | 50 % | 100 % | 100 % | 100 % | 200 % | 200 % |
| AUTOMATIC DOUBLE-SIDED PRINTING | 30 % | 75 % | 75 % | 75 % | 150 % | 150 % |

FIG.6B

PRINT MEDIUM 2

| | PRIMARY COLOR | | | | SECONDARY COLOR | TERTIARY COLOR |
|---|---|---|---|---|---|---|
| | Bk | Cyan | Magenta | Yellow | | |
| NORMAL PRINTING | 100 % | 100 % | 100 % | 100 % | 200 % | 300 % |
| MANUAL DOUBLE-SIDED PRINTING | 30 % | 75 % | 75 % | 75 % | 150 % | 150 % |
| AUTOMATIC DOUBLE-SIDED PRINTING | 30 % | 75 % | 75 % | 75 % | 150 % | 150 % |

FIG.6C

PRINT MEDIUM 3

| | PRIMARY COLOR | | | | SECONDARY COLOR | TERTIARY COLOR |
|---|---|---|---|---|---|---|
| | Bk | Cyan | Magenta | Yellow | | |
| NORMAL PRINTING | – | 100 % | 100 % | 100 % | 200 % | 300 % |
| MANUAL DOUBLE-SIDED PRINTING | – | 100 % | 100 % | 100 % | 200 % | 200 % |
| AUTOMATIC DOUBLE-SIDED PRINTING | – | 100 % | 100 % | 100 % | 200 % | 200 % |

INK JET APPARATUS AND INK JET PRINT METHOD HAVING A PLURALITY OF DOUBLE-SIDED PRINTING MODES

BACKGROUND OF THE INVENTION

1. Field of the Invention

The present invention relates to an ink jet print apparatus, an ink jet print method and a program for forming an image on a print medium by ejecting ink from a print head according to print data.

2. Descrption of the Related Art

Office automation equipment such as personal computers and word processors are in wide use today. A variety of printing apparatus and methods have been developed to record information output from these office equipment on various print media. There is a growing trend in office equipment for displaying video in color thanks to their improved processing capacity. In line with this trend, more and more printing apparatus capable of recording information in color are being developed.

Printing apparatus capable of forming a color image vary widely in price and function, ranging from low-cost devices with relatively simple functions to multifunctional ones that let user to select a desired print speed and quality according to the kind of an image to be printed and to its use. An ink jet printing apparatus in particular has found a wide use, such as on printers, copying machines and facsimiles, because of its many features including low noise, low running cost, small size, and relative ease with which a color image can be formed.

Generally, a color ink jet printing apparatus forms a color image using three color inks, cyan, magenta and yellow, or four color inks further including a black ink. Many of them use an aqueous liquid containing a coloring material. Thus, for an ink to soak into a print medium and dry there takes a certain length of time. Therefore, not many printing apparatus have been available which can perform a high-speed printing. Now that a variety of uses have been emerging as described above, there is a growing demand for a faster printing speed. In recent years high-speed printing apparatus are on the market which can print more than five, or even 10, A4-size sheets a minute.

Home-use ink jet printing apparatus are rapidly proliferating which can print a user-designed image including photograph on a large number of New Year postcards continuously. A printing apparatus is also reaching the market which can realize a so-called "full bleed printing" by which an image is printed to the edges of a print medium.

When a large number of postcards are to be printed, a normal process is as follows. First, only an address side or a message side (where a photograph or message is to be printed) of one or more cards is printed; and then the user turns over these cards and feeds them into the printing apparatus for printing on their opposite side. This procedure is troublesome for the user and there is a possibility of the user inserting the cards in a wrong direction. To deal with this problem, a printing apparatus has already been proposed which, as disclosed in Japanese Patent Application Laid-open No. 2000-191204, has an automatic reversing unit for automatically turning over sheets.

In the printing apparatus incorporating the automatic reversing unit, one side of the print medium is first subjected to an ordinary printing, after which the print medium is pulled back in the opposite direction to the automatic reversing unit installed in the printing apparatus. Upon receiving the print medium, the automatic reversing unit turns it over so that its unprinted side faces the printing unit then the print medium is transported from the automatic reversing unit to the printing unit. The printing unit prints on the unprinted side of the reversed print medium, which is then discharged from the printing apparatus. With the above steps automatically executed, the address side and the message side of a postcard can be printed in one process.

In the ink jet printing apparatus that performs the automatic double-sided printing, however, problems may arise during the transport process. They are explained as follows.

One of the problems is a curl of a print medium. Since the ink jet printing apparatus generally uses aqueous inks, after plain paper or ink jet paper absorbs inks, paper fibers may contract curling the paper. Particularly when the above "full bleed printing" is performed or when a small-sized postcard is printed with a plurality of color inks and therefore with a large volume of inks, the print medium absorbs inks up to its edge, which makes the curl phenomenon more conspicuous. If the double-sided printing is performed on the curled postcard, when the postcard is transported for the double-sided printing, ends of the card may be caught on parts of the automatic reversing unit or printing apparatus body, making it impossible for the card to be fed smoothly into the printing apparatus or the printing unit.

Further, since a fixing time of ink varies depending on the type of print medium and ink used and on ambient temperature and humidity, another problem arises from a failure to completely manage these factors.

In addition to printing high-quality photographic images on New Year greeting cards as described above, the user often prints simple documents and Internet web pages on plain paper on a daily basis. Actually, an appropriate kind of ink to be applied varies according to the use. In printing a high-quality photographic image, it is generally considered advantageous to use an ink composed mainly of a dye-based colorant with an excellent penetrability (hereinafter referred to as a penetrative ink). However, the penetrative ink is generally not vivid when printed on plain paper and thus not so suited to printing simple documents on plain paper on a daily basis. In contrast to this, ink capable of realizing a high-quality printing even on inexpensive plain paper is said to be an overlay type ink that contains such a colorant as pigment. Unlike the penetrative ink, the overlay type ink, when it uses a pigment as colorant, has larger colorant particles than a dye ink and thus cannot easily penetrate deep into fibers of the print medium, with the result that the colorant particles are more likely to stay on a surface layer of the print medium. Therefore, output images printed with the overlay type ink have a higher optical density than those printed with the penetrative ink. Further, since an ink penetration (spread) to the surrounding area is also smaller than when the penetrative ink is used, image boundaries are clearly printed. On the downside, since the colorant stays and becomes fixed near the surface layer of the print medium, the printed surface tends to be rough. This means it has a lower rubbing resistance than the penetrative ink. The degraded rubbing resistance gives rise to another problem that ink can easily come off even with a slight friction. Another drawback of the overlay type ink is a longer fixing time required than that of the penetrative ink.

To make the most of the features of these inks, an ink jet printing apparatus has been proposed which uses both of the penetrative ink and the overlay type ink (or dye ink and pigment ink). Such an ink jet printing apparatus often uses a pigment-based overlay type ink for only a black ink that is most consumed in document printing and dye-based penetrative inks for color inks (cyan, magenta and yellow inks including those of differing densities).

In such an ink jet printing apparatus incorporating inks with different features, when the above double-sided printing is performed, the ink fixing time for the first side of the print medium that is printed first varies depending on which ink is applied. If the print medium with the ink on the first side not yet fully dry is transported to the automatic reversing unit and turned over, the printed surface on which the ink is not yet fully fixed may directly come into contact with, and be rubbed by, inner mechanisms of the apparatus, causing many problems including a significant degradation of the print quality or a smearing of the inner mechanisms with ink. This in turn may lead to another problem of a secondary smear, in which the next print medium will be smeared by the contaminated inner mechanisms. Although the ink kind is taken as an example, the above problem similarly arises depending on the type of print medium used, ambient humidity and temperature.

As described above, the conventional printing apparatus with an automatic double-sided printing function cannot avoid a variety of problems completely. That is, depending on the type of print medium, the kind of ink and whether the "full bleed printing" is executed, the quality of a printed image formed by the automatic double-sided printing varies and the inner mechanisms of the printing apparatus are smeared. To cope with this situation, many of the currently available ink jet printing apparatus capable of automatic double-sided printing are constructed to allow a selection between a conventional, manual double-sided printing process and an automatic double-sided printing process using the automatic reversing unit. Thus, in performing the double-sided printing, the user must consider various conditions and decide which printing process, manual or automatic, should be used. That is, the conventional problems, including troublesome steps and a possibility of erroneous insertion on the part of the user, are not avoided completely.

SUMMARY OF THE INVENTION

The present invention has been accomplished to overcome the above problems and provide an ink jet print apparatus having a plurality of double-sided printing modes, each of which using different transport paths. It is also further object of this invention to provide an ink jet print apparatus, an ink jet print method and a program, all of which being capable of producing a sufficient image quality if any mode would be executed.

In the first aspect of the present invention, there is provided an ink jet printing apparatus using a print head having print elements to eject ink to print an image on a print medium, the apparatus comprising;

a first double-sided printing mode to print on both surfaces of the print medium; and a second double-sided printing mode to print on both surfaces of the print medium through a path different from that of the first double-sided printing mode;

wherein the maximum volume of ink applied to a unit area of a print medium for the first double-sided printing mode is smaller than that for the second double-sided printing mode.

In the second aspect of the present invention, there is provided an ink jet print system using a print head having print elements to eject ink to print an image on a print medium, the system comprising:

a print image data generation means for converting image data to be printed into print image data usable in a printing device having the print head; and an executing means to capable of executing a first double-sided printing mode to print on both surfaces of the print medium or a second double-sided printing mode to print on both surfaces of the print medium by using a path different from that of the first double-sided printing mode;

wherein the print image data generation means generates the print image data in one method when the first double-sided printing mode is executed and in another method when the second double-sided printing mode is executed.

In the third aspect of the present invention, there is provided an image processing apparatus to generate a print image data used in a printing apparatus which can execute a first double-sided printing mode to print on both surfaces of a print medium by ejecting ink from a print head and a second double-sided printing mode to print on both surfaces of the print medium using a path different from that used in the first double-sided printing mode, including;

a converting means for converting image data to be printed on the print medium into print image data be used in the printing apparatus;

wherein the converting means converts the image data so that an amount of ink applied to the print medium when the first double-sided printing mode is executed differs from that when the second double-sided printing mode is executed.

In the fourth aspect of the present invention, there is provided an ink jet print method using a print head having print elements to eject ink to print an image on a print medium, comprising the steps of:

selecting one printing mode from a plurality of printing modes, the printing modes including a first double-sided printing mode capable of printing on both surfaces of the print medium and a second double-sided printing mode capable of printing on both surfaces of the printing medium through a path different from that of the first double-sided printing mode;

converting image data to be printed into print image data to be used by a printing apparatus for printing according to the printing mode selected by the selection step; and printing on the print medium by the print head according to the print image data generated by the conversion step;

wherein the conversion step performs the data conversion so that an amount of ink applied to the print medium when the first double-sided printing mode is executed differs from that when the second double-sided printing means is executed.

In the fifth aspect of the present invention, there is provided a program for generating data which is used in a printing apparatus, wherein the printing apparatus comprising a print head having print elements to eject ink, a first double-sided printing mode capable of printing on both surfaces of a print medium, and a second double-sided printing mode capable of printing on both surfaces of the print medium through a path different from that of the first double-sided printing mode, the program being designed to cause a computer to execute the steps of:

deciding which of a plurality of printing modes, including the first double-sided printing mode and the second double-sided printing mode, is to be executed; and generating print image data to be used in the printing apparatus by converting image data to be printed into the print image data in such a way that an image is printed on the print medium at one print duty when the decision step decides to execute the first double-sided printing mode and at another print duty when the decision step decides to execute the second double-sided printing mode.

In the sixth aspect of the present invention, there is provided an ink jet print system using a print head having print elements to eject ink to print an image on a print medium, comprising:

a print image data generation means to convert image data to be printed into print image data printable by the print head;

a first print medium transport means to transport the print medium for printing; and a second print medium transport means to transport the print medium through a path different from that used by the first print medium transport means;

wherein the print image data generation means generates the print image data in one method when the first print medium transport means is operated and in another method when the second print medium transport means is operated.

In the seventh aspect of the present invention, there is provided an ink jet print method to print an image on a print medium by a print head having print elements to eject ink to, comprising the steps of:

deciding which of a plurality of print medium transport means capable of transporting the print medium through different paths in the process of printing on the print medium, is to be operated;

converting image data to be printed into print image data be used by a printing apparatus to print according to the print medium transport means determined by the decision step; and printing on the print medium by the print head according to the print image data generated by the conversion step;

wherein the conversion step performs the data conversion so that an amount of ink applied to the print medium is adjusted in accordance with the selected print medium transport means.

The above and other objects, effects, features and advantages of the present invention will become more apparent from the following description of embodiments thereof taken in conjunction with the accompanying drawings.

BRIEF DESCRIPTION OF THE DRAWINGS

FIGS. 6A to 6C show tables of output densities relative to an input density (print duties) for three types of print medium.

DETAILED DESCRIPTION OF PREFERRED EMBODIMENTS

Now, an embodiment of the present invention will be described in detail by referring to the accompanying drawings.

(Basic Construction)

Figure 1:
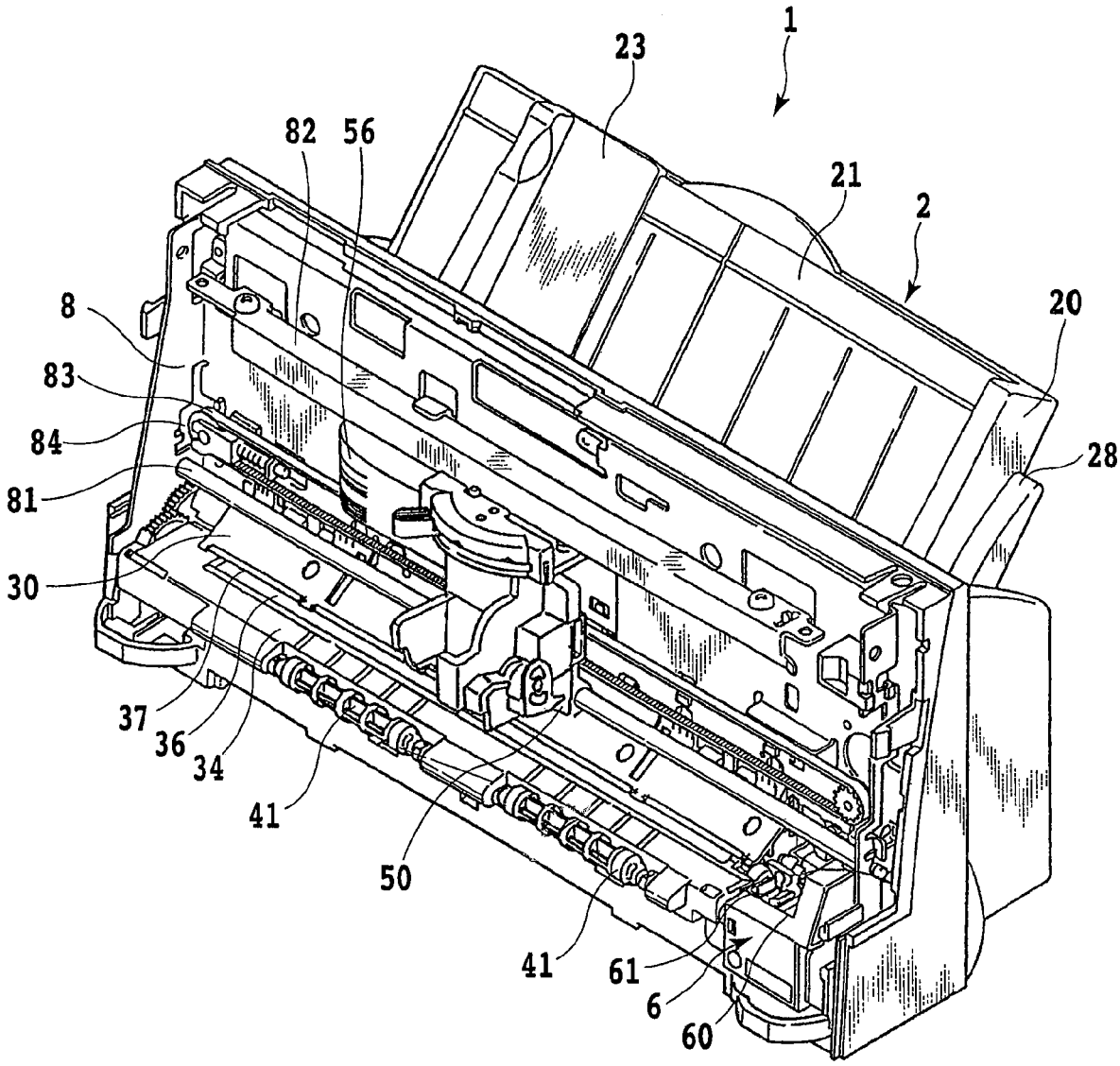
FIG. 1 is a perspective view showing a basic inner construction of an ink jet printing apparatus applied to an embodiment of this invention.
Figure 2:
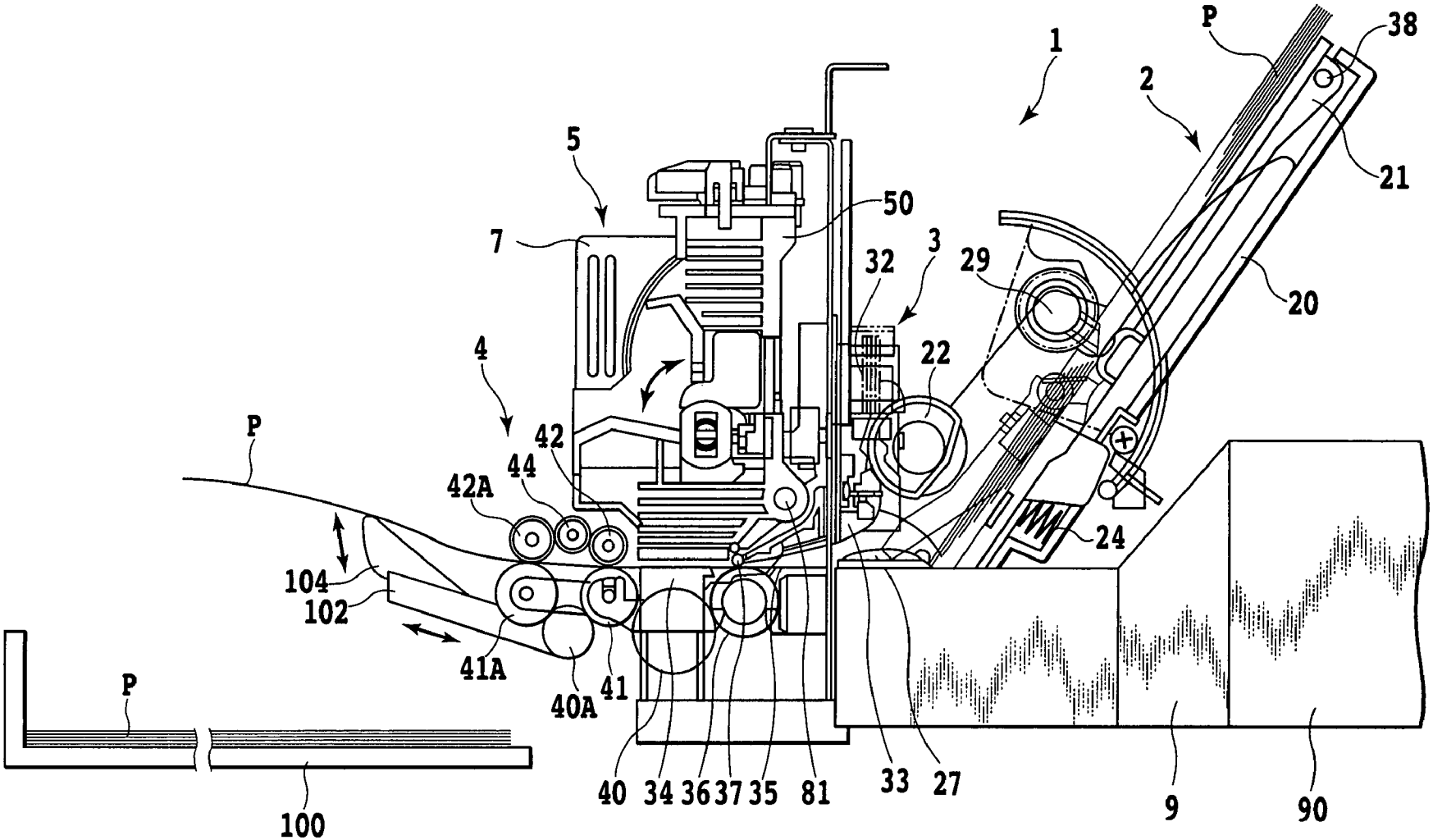
FIG. 2 is a cross-sectional view of the printing apparatus applied to the embodiment of this invention.

FIG. 1 is a perspective view showing a basic inner construction of an ink jet printing apparatus 1 applied to this embodiment. FIG. 2 is a cross section of the printing apparatus 1 as seen from one side.

Referring to FIG. 1 and FIG. 2, the ink jet printing apparatus 1 comprises mainly a paper supply unit 2, a feed unit 3, a discharge unit 4, a carriage unit 5, and an automatic double-sided printing unit 9 including a removable reversing unit. These components will be briefly explained one by one in the following.

(I) Paper Supply Unit

The paper supply unit 2 has mounted on a base 20 a pressure plate 21, on which sheets of a print medium P are placed, and a supply rotor 22 to supply the print medium P. A movable side guide 23 is slidably mounted on the pressure plate 21 to restrict a mounting position of the print medium P. The pressure plate 21 is rotatable about a rotating shaft connected to the base 20 and biased toward the supply rotor 22 by a pressure plate spring 24. At a portion of the pressure plate 21 facing the supply rotor 22, a separation pad not shown which is made of a material with a large friction coefficient, such as an artificial leather, is provided to prevent a multiple sheet supply. The base 20 is also provided with a separation claw not shown, a bank portion 27, a selection lever 28 and a release cam 29. The separation claw covers corners of the print medium P at one end thereof and has a function of separating the print medium one sheet at a time. The bank portion 27 is formed integral with the base 20 to separate thick paper which cannot be dealt with by the separation claw. The selection lever 28 at a plain paper position puts the separation claw into operation and, at a thick paper position, takes it out of operation. The release cam 29 disengages the pressure plate 21 from the supply rotor 22.

In the above construction, during a standby state the release cam 29 pushes down the pressure plate 21 to a predetermined position. So, the pressure plate 21 is disengaged from the supply rotor 22. In this state when a drive force of a transport roller 36 is transmitted through gears to the supply rotor 22 and the release cam 29, the release cam 29 parts from the pressure plate 21 allowing the pressure plate 21 to rise. As a result, the print medium P comes into contact with the supply rotor 22 and can be picked up and supplied as the supply rotor 22 rotates. The print medium P is separated one sheet at a time by the separation claw and supplied to the feed unit 3. The supply rotor 22 and the release cam 29 continue to rotate until the print medium P reaches the feed unit 3. When the print medium P has reached the feed unit 3, the release cam 29 disengages the print medium P from the supply rotor 22, thus entering the standby state again. At the same time, the drive force from the transport roller 36 is cut off.

(II) Feed Unit

The feed unit 3 has a transport roller 36 to transport the print medium P and a PE sensor 32. A pinch roller 37 is held in contact with the transport roller 36 so that it is rotated by the transport roller 36.

The pinch roller 37 is rotatably supported on a pinch roller guide 30. The pinch roller guide 30 is biased by a pinch roller spring to press the pinch roller 37 against the transport roller 36 to create a transporting force for the print medium P. At an inlet of the feed unit 3 to which the print medium P is fed, an upper guide 33 for guiding the print medium P and a platen 34 are arranged. The upper guide 33 is provided with a PE sensor lever 35 that transmits a detection of front and rear ends of the print medium P to the PE sensor 32.

In the above construction, the print medium P supplied to the feed unit 3 is guided by the platen 34, pinch roller guide 30 and upper guide 33 and fed to a roller pair of the transport roller 36 and the pinch roller 37. At this time, the front end of the print medium P is detected by the PE sensor lever 35 and the detection information is used to determine a print position of the print medium P. The print medium P is held between the paired rollers 36, 37 driven by an LF motor not shown and thereby transported over the platen 34.

A print head 7 is a replaceable ink jet print head that has a removable ink tank. The print head 7 has a plurality of print elements, each provided with an electrothermal transducer such as a heater. Energizing the heater causes a film boiling in ink contained in each print element. A bubble produced in ink by the film boiling expands and contracts to produce a pressure change and thereby eject an ink droplet from the print element. The ink droplet thus ejected lands on the print medium P to form a dot.

(III) Carriage Unit

The carriage unit 5 has a carriage 50 on which to mount the print head 7. The carriage 50 is supported by a guide shaft 81, along which the carriage 50 is reciprocally scanned in a direction crossing the transport direction of the print medium P, and by a guide rail 82 that holds the rear end of the carriage 50 to maintain a gap between the print head 7 and the print medium P. The guide shaft 81 and the guide rail 82 are secured to a chassis 8.

The carriage 50 is driven through a timing belt 83 by a carriage motor mounted on the chassis 8. The timing belt 83 is supported, with an appropriate tension, between idle pulleys 84. Further, the carriage 50 has a flexible cable 56 to transmit a signal from a printed circuit board to the print head 7.

In the above construction, when an image is to be formed on the print medium P, the paired rollers 36, 37 feed the print medium P to a row position where an image is to be formed (a position in a transport direction of the print medium P). At the same time, the carriage motor 80 moves the carriage 50 to a column position where an image is to be formed (a position in a direction perpendicular to the transport direction of the print medium P) to have the print head 7 face the image forming position. Then, as the carriage 50 is moved, the print head 7 ejects ink onto the print medium P according to a signal from the printed circuit board to form an image.

Before mounting or dismounting the print head 7 to or from the carriage 50 or mounting or dismounting an ink tank to or from the print head 7, the user presses an operation key not shown. This causes the carriage 50 to move to a predetermined position where the user performs dismounting or replacement.

(IV) Cleaning Unit

The cleaning unit 6 has a pump 60 for cleaning the print head 7, a cap 61 for preventing the print head 7 from drying, and a selection arm for switching the drive force from the transport roller 36 between the paper supply unit 2 and the pump 60. During other than paper feeding and cleaning, the selection arm fixes a planetary gear (not shown), which rotates about an axis of the transport roller 36, at a predetermined position so that its drive force is not transmitted to the paper supply unit 2 or the pump 60. When the carriage 50 moves, the selection arm frees the planetary gear, allowing the planetary gear to move according to the forward or backward rotation of the transport roller 36. That is, when the transport roller 36 rotates forward, the drive force is transmitted to the paper supply unit 2; and when the transport roller 36 rotates backward, the drive force is transferred to the pump 60.

(V) Discharge Unit

The discharge unit 4 has discharge rollers 41, 41A, a transfer roller 40 that engages the transport roller 36 and the discharge roller 41, and a transfer roller 40A that engages the discharge roller 41 and discharge roller 41A. The drive force of the transport roller 36 is therefore transmitted through the transfer roller 40 to the discharge roller 41, from which it is further transmitted through the transfer roller 40A to the discharge roller 41A.

Spurs 42, 42A are placed in contact with the discharge rollers 41, 41A so as to be rotated by the discharge rollers 41, 41A. Further, a cleaning roller 44 rotatably engages the spurs 42, 42A. In the above construction, the print medium P that was formed with an image by the carriage unit 5 is gripped and transported between the discharge rollers 41, 41A and the spurs 42, 42A and discharged onto a discharge tray 100.

Downstream of the discharge roller 41A there is a discharged paper support 104 for supporting the discharged printed medium P. The discharged paper support 104 is pivotally mounted to a guide member 102. The guide member 102 supports the print medium P almost horizontally movable between a position where the print medium P protrudes from the platen 34 and a position where the print medium P is retracted onto the platen 34. As the guide member 102 moves, the discharged paper support 104 also pivots.

(VI) Automatic Double-Sided Printing Unit

Figure 3:
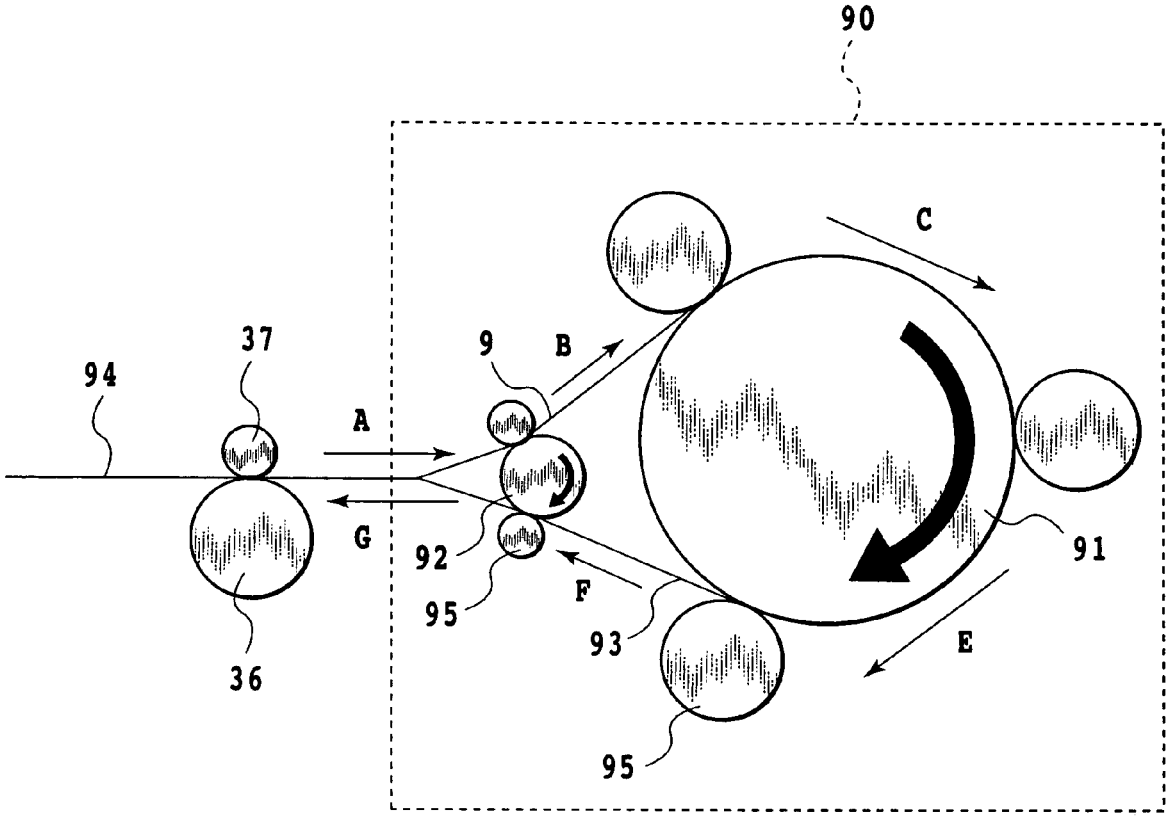
FIG. 3 is a schematic diagram showing the construction of an automatic double-sided printing unit applicable to the embodiment of this invention.

FIG. 3 is a schematic diagram showing the construction of an automatic double-sided printing unit applicable to this embodiment.

The automatic double-sided printing unit 9 comprises a paper supply path 94, the transport roller 36 and a reversing unit 90 installed behind the ink jet printing apparatus 1. The reversing unit 90 is removable from the printing apparatus and, when it is mounted on the printing apparatus, the automatic double-sided printing unit 9 is formed.

The reversing unit 90 mainly comprises a paper holding roller 95, a reversing small roller 92, a loop-shaped reversing path 93, and a reversing large roller 91.

The transport roller 36 can be driven in the forward and backward direction by the transport motor. When the double-sided printing is to be performed, the transport roller 36 is first rotated forwardly to transport the print medium P from the paper supply unit 2 toward the discharge unit 4 to perform printing on a front surface (first surface) of the print medium P. After the printing is finished, the transport roller 36 is rotated backward to move the print medium P along the paper supply path 94 in the backward direction (from A to B) until the print medium P enters the reversing path 93. Once the print medium P enters the reversing path 93, the reversing small roller 92 and reversing large roller 91 are rotated in the direction of arrows, moving the print medium P along the transport path from B to C to E to F, with the result that the print medium P is turned upside down. After being turned over, the print medium P is transported along the paper supply path 94 again, this time in the forward direction (G direction) so that the back surface (second surface) of the print medium P can be printed by the print head 7. Then, the print medium P printed on both sides is discharged onto the discharge unit 4.

As described above, in the automatic double-sided printing unit 9, the print medium P passes through the reversing path 93 from A to B to C to E to F to G to complete the first/second surface inversion.

The outline construction of the ink jet printing apparatus applied to this embodiment has been described with reference to FIG. 1 to FIG. 3.

Figure 4:
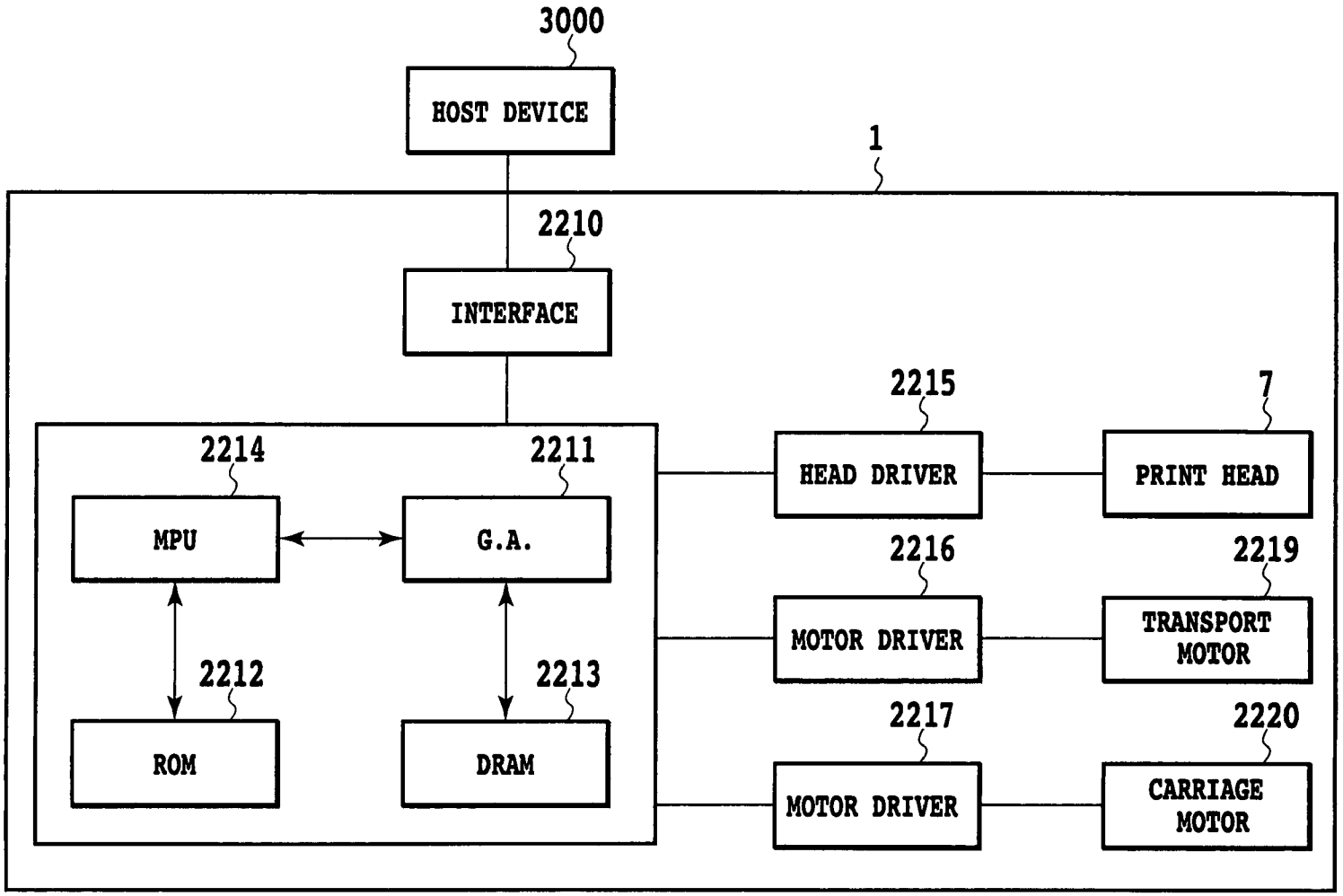
FIG. 4 is a block diagram showing an electric control configuration of the ink jet printing apparatus applied to the embodiment of this invention.

FIG. 4 is a block diagram showing a configuration of an electric control of the ink jet printing apparatus applied to this embodiment. In this embodiment, the printing apparatus 1 and a host device 3000 together are referred to as an ink jet print system.

In FIG. 4, reference number 2210 denotes an interface to transfer signals to and from the host device 3000. Through this interface 2210 image information can be taken into the printing apparatus. Denoted 2214 is an MPU, which, according to a program stored in a ROM 2212, performs a general control on the printing apparatus. Designated 2211 is a gate array, and 2213 a DRAM capable of temporarily storing image information from the gate array 2211.

Denoted 7 is a print head which is driven by a head driver 2215. A transport motor 2219 is driven by a motor driver 2216 to transport a paper. A carriage motor 2220 is driven by a motor driver 2217 to move the carriage.

In performing a printing operation, image data is received via the interface 2210 and stored in the DRAM 2213. The stored image data is converted for each line by the gate array 2211 from raster data into a print image recordable by the print head 7 and then stored again in the DRAM 2213. The print image is then transferred through the gate array 2211 to the head driver 2215, which drives the print head 7 according to the received signal. The print head 7 causes a plurality of print elements of the associated rasters to eject ink according to the drive signals to perform printing. The gate array 2211 has a print data counter to count the number of printed dots.

The motor driver 2217 drives the carriage motor 2220 to move the carriage mounting the print head 7 in the main scan direction. The scan speed matches an ejection speed (ejection frequency) of the print head 7.

The MPU 2214 performs an interrupt control on the gate array 2211 every 10 msec to read an accumulated value of the counter. It then calculates the number of dots printed per unit time and determines a print duty for a unit area from a relation with the carriage scan speed.

After the carriage scan, which is performed while ejecting ink from the print head 7, is completed for one line, the motor driver 2216 drives the transport motor 2219 to feed the print medium a predetermined distance. By alternating the main scan of the print head and the subscan of the print medium as described above, an image is formed progressively on the print medium.

(Ink Characteristic)

The kind and characteristic of ink applied to this embodiment will be explained as follows.

In the printing apparatus of this embodiment, a color ink tank containing a plurality of color ink and a black ink tank are removably mounted to the print head 7 so that they can be replaced independently of each other. It is noted, however, that this construction does not limit this embodiment in any way. For example, a disposable type print head formed integral with ink tanks of all colors may be used.

The print head 7 of this embodiment has a plurality of print elements for each of yellow, magenta, cyan and black ink. Color print elements (yellow, magenta and cyan) each eject about 5 ng of ink and black print elements about 3 ng of ink.

An example composition of each ink is described below.

| | |
|---|---|
| 1. Y (yellow) | |
| C.I. Direct Yellow 86 | 3% |
| Diethylene glycol | 10% |
| Isopropyl alcohol | 2% |
| Urea | 5% |
| Acetylenol EH (Kawaken Fine Chemicals Co., Ltd.) | 1% |
| Water | 79% |

-continued

| | |
|---|---|
| 2. M (magenta) | |
| C.I. Acid Red 289 | 3% |
| Diethylene glycol | 10% |
| Isopropyl alcohol | 2% |
| Urea | 5% |
| Acetylenol EH (Kawaken Fine Chemicals Co., Ltd.) | 1% |
| Water | 79% |
| 3. C (cyan) | |
| C.I. Direct Blue 199 | 3% |
| Diethylene glycol | 10% |
| Isopropyl alcohol | 2% |
| Urea | 5% |
| Acetylenol EH (Kawaken Fine Chemicals Co., Ltd.) | 1% |
| Water | 79% |
| 4. Bk (black) | |
| C.I. Direct Black 154 | 3% |
| Diethylene glycol | 10% |
| Isopropyl alcohol | 2% |
| Urea | 5% |
| Water | 80% |

Acetylenol EH is a kind of surfactant that has an effect of improving a penetrability of ink. In this embodiment, only the color inks other than black are given 1% of Acetylenol EH and are therefore made penetrative inks. In addition to Acetylenol EH, other surfactants and alcohols may be used as additives for improving the ink penetrability. Improving the ink penetrability in this way can facilitate the fixing of ink and thus prevent different color inks from bleeding and mixing together on a print medium. However, an ink with an improved penetrability soaks deeper and wider along fibers of the print medium, so an image (particularly character) quality degradation problem such as feathering may occur. Therefore, in this embodiment, no additives such as Acetylenol EH are added to a black ink to realize a clear character quality without feathering.

Although the inks listed above all use dyes as a colorant, other colorants than dyes, such as pigments, may also be used.

If the double-sided printing is to be performed, the printing apparatus of this embodiment can choose between a mode in which the automatic double-sided printing unit is operated and a mode in which it is not used, as in the printing apparatus disclosed in the background art section. However, the two modes provided in the printing apparatus of this invention differ from each other in a presence or an absence of the use of the automatic double-sided printing unit but not just in it. The most characteristic of this embodiment is that the double-sided printing image data for these two modes are generated independently of each other by different methods.

By referring to the drawings, the feature of this invention will be explained in detail in a plurality of examples.

Figure 5:
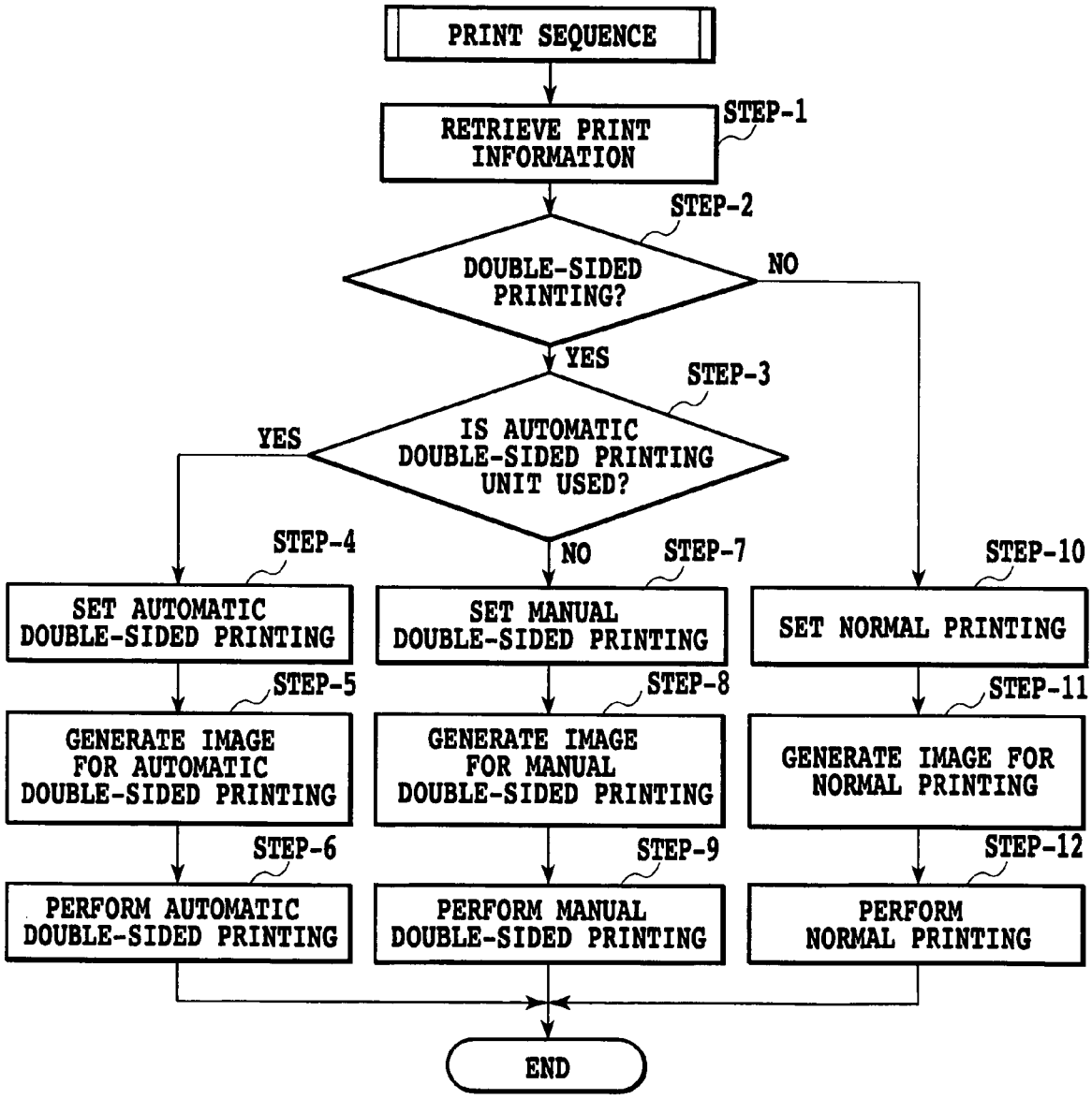
FIG. 5 is a flow chart showing a control flow when a printing operation is performed in Example 1.

FIG. 5 is a flow chart showing a control flow in a printing process in a first example. Here, a case is taken up, in which steps other than Step-6, 9, 12 are performed by a printer driver in the host device and in which Steps-6, 9, 12 are performed by the printing apparatus. This example is not limited to this configuration. All steps may be performed by the printing apparatus or only a part of other steps than Step-6, 9, 12 may be performed by the printing apparatus.

In Step-1, print information to be used in actual printing is retrieved. Here, the print information may include, for example, information on the size of print medium, an image quality, the type of print medium, whether a double-sided printing is performed, and whether the automatic double-sided printing unit (or the reversing unit) is used. These information can be set, for example, by the user on a printer driver installed in the host device.

In Step-2, a check is made to see if the double-sided printing is requested. If it is decided that the double-side printing is to be performed, the processing proceeds to Step-3.

Step-3 checks if the automatic double-sided printing unit (reversing unit) is to be used or not. If it is decided that the printing process requires the use of the automatic double-sided printing unit (reversing unit), the processing moves to Step-4, where it sets an automatic double-sided printing mode. Step-5 generates print image data for the automatic double-sided printing according to the setting made by Step-4. Then, Step-6 executes the automatic double-sided printing operation using the print image data generated by Step-5. Now, this sequence is ended.

If Step-3 decides that the printing process does not use the automatic double-sided printing unit, the processing moves to Step-7, where it sets a manual double-sided printing mode. Step-8 generates print image data for the manual double-sided printing according to the setting made by Step-7. Then, Step-9 executes the manual double-sided printing operation using the print image data generated by Step-8. Now, this sequence is ended.

If Step-2 decides that the printing process is not the double-sided printing, the processing proceeds to the Step-10, where it sets a normal printing operation. At Step-11, print image data for the normal printing is generated according to the setting made by Step-10. Then, the processing moves to Step-12, where it executes the normal printing according to the print image data generated by Step-11. Now, this sequence is ended.

Here, the image generation performed by Step-5 will be explained. Step-5 is a step to convert the image data to be printed into print data that can be printed by the printing apparatus. Normally, this step involves converting multi-valued image data into print data that precisely represents the image and quantizing it. Since the print mode set by Step-4 determines a maximum volume of ink that can be applied to a unit area of the print medium, Step-5 performs the conversion processing so that the image formed does not exceed the maximum volume of ink. Similarly, Step-8 and Step-11 also perform the conversion processing so that the image generation can be done without exceeding the maximum ink application volume of the associated print mode. The maximum volume of ink to be set for the automatic double-sided printing mode is smaller than that to be set for the manual double-sided printing mode.

FIGS. 6A to 6C show tables of a real output density (print duty) of each color with respect to a 100% input density (parameter) for three types of print medium when Step-11, Step-8 and Step-5 generate print image data for the normal printing, manual double-sided printing and automatic double-sided printing. Suppose, for example, the printing apparatus of this embodiment prints an image with a resolution of 600 dpi (dots/inch). A printed state in which an ink drop is applied to every pixel in a predetermined area is represented as a 100% duty. Thus, a secondary color formed by overlapping two different inks has a maximum duty of 200% and a tertiary color formed by overlapping three different inks has a maximum duty of 300%. In the ink jet printing apparatus of this embodiment, since the amount of ink ejected from each print element is fixed, setting a print duty automatically determines the amount of ink applied to the print medium.

In the case of print medium 1, the normal printing performs a 100% duty printing with respect to the input parameter for primary colors of black, cyan, magenta and yellow.

In the manual double-sided printing, primary colors are printed at 100% except for black which is printed at 50%. Secondary and tertiary colors are both printed at 200%. The reason that black is limited to 50% is to minimize an image quality degradation and smear that would otherwise occur when the double-sided printing is done using a black ink which has a slow penetration speed. Further, for tertiary colors, the print duty is reduced from 300% to 200% as a countermeasure against a print-through visible on print verso and curling during the double-sided printing.

In the automatic double-sided printing, primary colors are printed at 75% and black at 30%, and secondary and tertiary colors are both printed at 150%. The black is limited to 30% to minimize an image quality degradation and smear that would otherwise occur when the double-sided printing is performed by the automatic double-sided printing unit using a black ink which has a slow penetration speed. Further, for secondary and tertiary colors, the ink application volume is reduced to 150% as a countermeasure against a print-through and curling during the double-sided printing using the automatic double-sided printing unit.

As described above, in this example the output print duty setting differs between the manual double-sided printing, the automatic double-sided printing and the normal printing. The reason that the manual double-sided printing and the automatic double-sided printing are given different output print duties is as follows.

In performing the manual double-sided printing, the user generally performs the printing and discharge processing continuously on a plurality of print medium sheets on only one surface (first surface). Then, the user turns over the discharged, stacked sheets, sets them in the paper supply unit 2, and performs printing on the other unprinted surface (second surface) for all sheets en masse. In this case, since the first and second surfaces of each sheet are printed at a relatively long interval, it is highly likely that, by the time the second surface is printed, the ink applied to the first surface will already be fixed well. In the automatic double-sided printing on the other hand, the print medium sheet, after being printed on the first surface, is pulled into the printing apparatus and turned over in the automatic double-sided printing unit for second surface printing. Thus, the first and second surfaces of the same sheet are printed continuously at a relatively short interval. If a print duty is high, there is a possibility of the ink applied to the first surface not being fixed well by the time the second surface is printed. Therefore, in this embodiment, by setting the applied ink volume smaller in the automatic double-sided printing than in the manual double-sided printing, the problems that are feared to arise during the automatic double-sided printing are resolved.

In the above, the black print duty is lowered in the manual and automatic double-sided printing. This may result in a reduction in the black character density. To deal with this problem, a tertiary color made up of color inks, cyan, magenta and yellow, may be used to produce a PCBk (Process Color Black) to replace or be added to the black image portion. In this case, it is preferred that the print duty be set less than a value shown in a tertiary color column.

In either of the manual and automatic double-sided printing, the print duty of the overlay type black ink is set lower than those of the penetrative color inks. This is because the overlay type black ink is not as good as the penetrative color inks in terms of fixing and rubbing resistance characteristics and is more likely to induce a smear problem.

In the case of print medium 2, print duties for the normal printing are equal to those of the print medium 1. However, unlike the print medium 1, the print medium 2 has the same print duty settings for the manual double-sided printing and the automatic double-sided printing. Here the print medium 2 is assumed to have a characteristic that the rubbing and fixing problems have greater effects on the print quality than does the print medium transport process of the automatic reversing unit. For such a print medium, the above print duty settings reflects a fact that it is considered necessary to take positive countermeasures against the rubbing and fixing problems and also a curling problem by reducing the print duty for both the manual and automatic double-sided printing operations.

In the case of print medium 3, no black ink is used. In this example, the print medium 3 is assumed to have a relatively glossy surface. For a combination of this print medium and the above inks, the rubbing and fixing problems are likely to occur with a black ink, so this example prints all black images using the abovementioned PCBk. However, the use of PCBk increases the ink application volume which in turn may cause a curling problem. Thus, this example allows the print duty to be reduced and set to an appropriate value in each of the manual and automatic double-sided printing to deal with these problems.

While three types of print medium have been described in the above, it is noted that the print medium is not limited to these. It is possible to set the print duty at a lower than normal level for a print medium that is prone to curl and a print medium dedicated for double-sided printing.

As described above, in performing the double-sided printing, this example generates print image data for the manual double-sided printing and for the automatic double-sided printing independently of each other by properly controlling print duties. More specifically, the handling of the print medium is selected according to a difference in the print medium transport path in the printing apparatus, for instance, according to whether or not the print medium is passed through the automatic double-sided printing unit 9.

With this arrangement an ink jet printing apparatus is realized which, when the automatic double-sided printing unit is used, allows double-sided printing to be executed automatically on a large number of print medium sheets at high speed without requiring any processing on the part of the user and which at the same time can eliminate a number of problems experienced with conventional printing apparatus, such as the degradation of image quality, the contamination of interior of the printing apparatus and the smudge problem, and thereby maintain a high image quality during the double-sided printing.

This example described above can be applied to a broad scope of print medium types. Particularly when postal cards and ink jet cards, which are often printed on both sides, are used, the advantages of this embodiment are enormous.

Next, a second example of this invention will be described.

This embodiment chooses a printing method best suited to a particular transport process including a print medium supply, transport and discharge (referred to as a paper path in this example) and generates optimum print data for that paper path. Consider a case, for example, where a double-sided printing is performed. A transport path (paper path) taken when the print medium is supplied from ASF manually for printing on one surface at a time differs from that taken when the print medium is passed through the automatic double-sided printing unit for printing on both surfaces. In a printing apparatus having multiple kinds of paper paths, this example generates image data that changes according to the paper path used.

Figure 7:
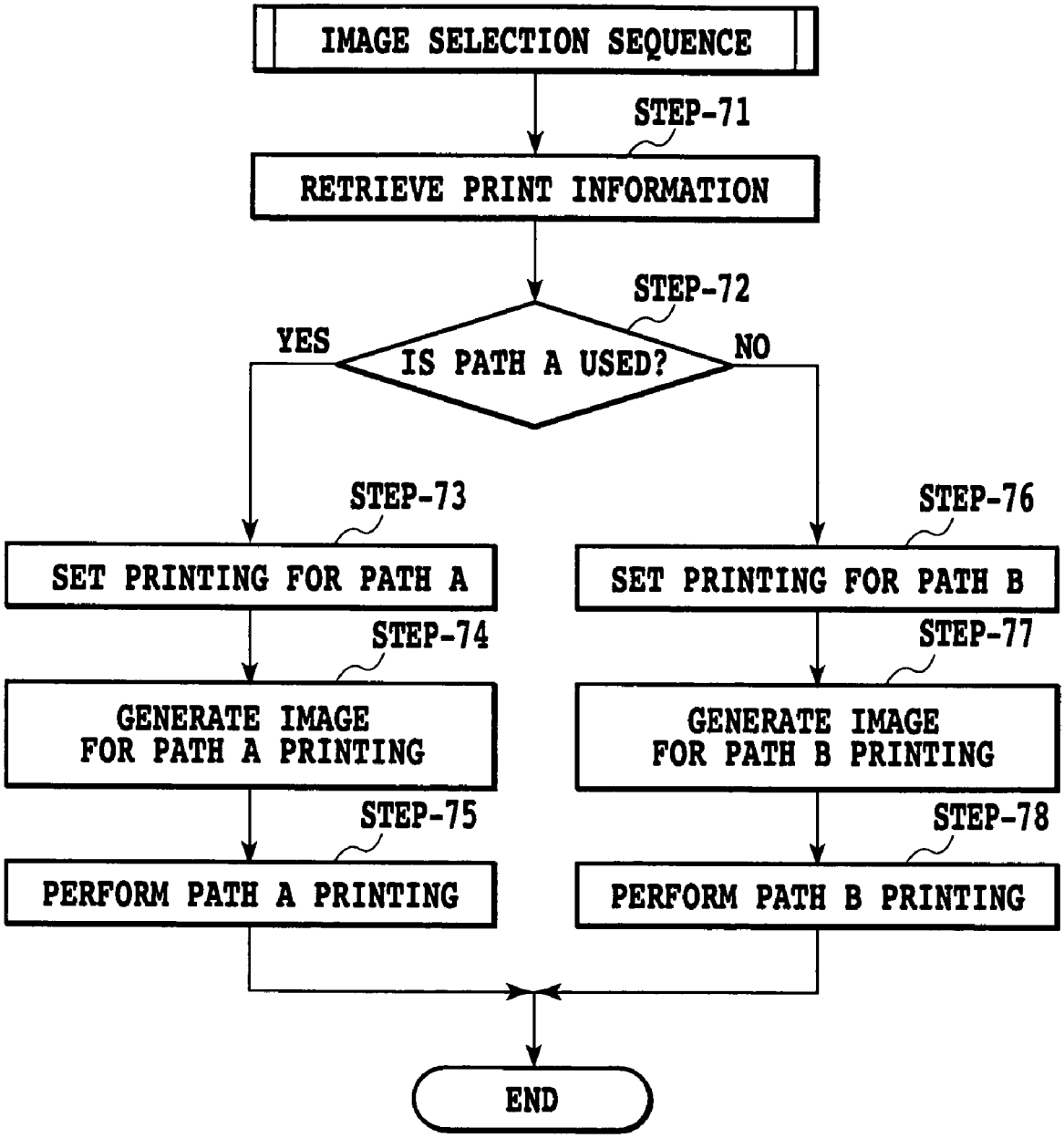
FIG. 7 is a flow chart showing a control flow when a printing operation is performed in Example 2.

FIG. 7 is a flow chart showing a flow of control in performing printing in this example.

First, at Step-71 information associated with actual printing (print information) is retrieved. The information associated with actual printing includes, for instance, a print medium size, an image quality, a print medium type, whether or not double-sided printing is performed, and whether or not the automatic double-sided printing unit is used. These information can be set by the user on a printer driver installed in a host device.

Step-72 checks if the printing is to be performed through a paper path A. In the printing apparatus of this example, two kinds of paper paths, A and B, are provided. If it is decided that the paper path A (e.g., a transport process using the automatic double-sided printing unit 9 including the reversing unit 90) is used, the processing moves to Step-73. If it is decided that a paper path B (e.g., a transport process not using the automatic double-sided printing unit 9) is used, the processing proceeds to step-76.

Step-73 makes a print setting for the paper path A. Step-74 generates print image data for the paper path A printing according to the setting made by Step-73. Then, Step-75 executes the paper path A printing according to the print image data generated by Step-74. Now, this sequence is ended.

Step-76 on the other hand makes a print setting for the paper path B. At Step-77, print image data for the paper path B printing is generated according to the setting made by Step-76. Then, Step-78 executes the paper path B printing according to the print image data generated by Step-77. Now, this sequence is ended.

When Step-74 and Step-77 generate print image data for the paper path A and paper path B, respectively, a correspondence table of FIGS. 6A to 6C or its equivalent representing a relation between a 100% input density and a real output density (print duty) for each color can be applied, as in Example 1. When the correspondence table of FIGS. 6A to 6C are applied, it is preferred that the print duties in a row of the automatic double-sided printing be used for the path A and those in a row of the manual double-sided printing for the path B. In the case of paper path A in which the print medium is transported through the automatic double-sided printing unit 9, a relatively short period of time after one of its surfaces has been printed, the print medium is transported to the automatic double-sided printing unit 9 where it is turned upside down. This means that the printed surface will contact the transport path in a relatively short time. Therefore, when the path A is used, the print duties need to be set relatively low.

In the case of paper path B in which the print medium is transported without being passed through the automatic double-sided printing unit 9, the print medium, after one of its surfaces has been printed, is discharged out of the printing apparatus. In a one-sided printing, the printed surface will not contact the transport path. Even in the double-sided printing, the only time that the printed surface contacts the transport path is when it is supplied again into the printing apparatus. So, the time it takes for the printed surface to contact the transport path is relatively long. This means that in the case of paper path B, the print duties can be set relatively higher than those of paper path A.

While we have described an example printing apparatus having two kinds of paper paths, A and B, this invention is of course effective if three or more paper paths are provided.

In a printing apparatus having a plurality of paper paths, this example generates print image data for each of the paper path independently to properly control the print duty according to the selected paper path. This makes it possible to provide an ink jet printing apparatus that stably maintains a high image quality whichever paper path is chosen.

Different paper paths taken when the automatic double-sided printing unit is used and when it is not, have significantly differing influences on an image quality. It is therefore effective to provide an appropriate print medium handling by adjusting the print duty and generating print image data according to a selected print medium transport process in the printing apparatus, e.g., according to whether or not a paper path running through the automatic double-sided printing unit is used.

This example described above can be applied to various types of print medium, as in Example 1. Particularly when postal cards and ink jet postal cards, which are often printed on both sides, are used, the advantages of this example are enormous.

With this example, it is also possible to deal with variations in paper paths, which occur not only according to whether or not the automatic double-sided printing unit described in Embodiment 1 is used but also when different kinds of automatic reversing units are employed or when a one-sided printing is provided with different paper paths. This in turn allows problems of rubbing, ink fixing, smear and curling to be dealt with more reliably, providing a printing system free from image problems.

Implementing the present invention in the form of the above two examples can produce a stable image quality without causing troubles experienced with the conventional printing apparatus, whichever transport process is chosen during printing. The user can use the automatic double-sided printing unit without regard to problems that may occur with conventional printing apparatus when a print medium prone to a curling problem is used, when an overlay type ink is used, when a "full bleed printing" is performed, or when printing is done under a variety of conditions including ambient temperature and humidity.

Although the embodiments of this invention have been described as an ink jet print system having the printing apparatus 1 externally connected to the host device 3000, as shown in FIG. 4, this invention is not limited to this configuration. For example, the external device to which the printing apparatus is connected is not necessarily a host device but may be digital cameras and other information devices.

Further, while the print image data may be generated by a printer driver installed in the host device 3000, it may also be generated by the printing apparatus 1. If the print image data is generated by the printer driver in the host device, the print image data is transferred to the printing apparatus, which then performs printing according to the print image data.

Further, rather than a configuration in which the printing apparatus is externally connected to an information device, this invention is also effectively applied to a configuration in which all controls are performed by a totally integrated ink jet print system.

Further, in the above examples, the method of controlling the print duty has been described as an example means to adjust the amount of ink applied to the print medium. This is an effective method particularly when the ink volume ejected from each print element is fixed to a predetermined volume as in the ink jet printing apparatus of this embodiment. However, in this embodiment, the means to adjust the amount of ink applied to the print medium is not limited to the above configuration. For example, when an ink jet printing apparatus is used that can modulate the ink volumes ejected from the individual print elements, the amount of ink applied to the print medium can be adjusted by modulating the print element ink ejection volumes or by combining the control of the print duty with the modulation of the print element ink ejection volumes.

In the above embodiments while the reversing unit 90 has been described to be mountable on the printing apparatus, it may be formed integral with the printing apparatus. In that case, the automatic double-sided printing unit 9 is incorporated in the printing apparatus.

Further, this invention can be applied either to a system comprising a plurality of devices (e.g., host computer, interface device, reader, printer, etc.) or to an apparatus comprising a single device (e.g., copying machine and facsimile).

The scope of this invention further includes the following implementation. That is, an apparatus or system connected to a variety of devices incorporates a computer (CPU or MPU), which is loaded with software program codes and runs the program to operate the devices to realize various functions of the above embodiments.

In that case, the software program codes themselves realize the functions of the above embodiments. Thus, the program codes and a means to supply the program codes to the computer, for example a storage media storing the program codes, together constitute the invention.

Storage media for storing the program codes may include, for example, floppy disks, hard disks, optical discs, magnetooptical discs, CD-ROMs, magnetic tapes, non-volatile memory cards and ROMs.

The program codes are included in the embodiment of this invention not only when the functions of the above examples are realized by the computer executing the supplied program codes but also when the program codes cooperate with an operating system running on the computer or with other application programs to realize the functions of the above embodiments. For example, program codes corresponding to at least a part of the flow charts of FIG. 5 and FIG. 7 are included in the scope of this invention.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2003-290734 filed Aug. 8, 2003, which is hereby incorporated by reference herein.

What is claimed is:

1. An ink jet printing apparatus using a print head having print elements to eject ink to print an image on a print medium, the apparatus comprising:

a first double-sided printing mode to print on both surfaces of the print medium; and a second double-sided printing mode to print on both surfaces of the print medium through a path different from that used in the first double-sided printing mode, wherein the maximum volume of ink applied to a unit area of a print medium in the first double-sided printing mode is less than that in the second double-sided printing mode.

2. An ink jet printing apparatus according to claim 1, wherein the first double-sided printing mode is executed to print on one surface of the print medium and then to print on another surface of the print medium, without discharging the print medium.

3. An ink jet printing apparatus according to claim 1, wherein the first double-sided printing mode is executed to perform printing according to print image data generated in such a manner that the maximum volume of ink applied to a unit area in the first double-sided printing mode is less than that in the second double-sided printing mode.

4. An ink jet printing apparatus according to claim 3, wherein the first double-sided printing mode performs an automatic double-sided printing in which, after a printing operation is carried out on one surface of the print medium, the print medium is turned over automatically in the printing apparatus without discharging the print medium, and then the printing operation is carried out on another surface of the print medium, and wherein the second double-sided printing mode performs a manual double-sided printing in which, after a printing operation is carried out on the one surface of the print medium, the print medium is discharged from the printing apparatus, and then the printing operation is carried out on the other surface of the print medium supplied into the printing apparatus by a user.

5. An ink jet print system using a print head having print elements to eject ink to print an image on a print medium, the system comprising:

print image data generation means for convening image data to be printed into print image data usable in a printing device having the print head; and executing means capable of executing a first double-sided printing mode to print on both surfaces of the print medium or a second double-sided printing mode to print on both surfaces of the print medium by using a path different from that used in the first double-sided printing mode, wherein the print image data generation means generates the print image data by one method when the first double-sided printing mode is executed and by another method when the second double-sided printing mode is executed.

6. An image processing apparatus to generate print image data used in a printing apparatus which can execute a first double-sided printing mode to print on both surfaces of a print medium by ejecting ink from a print head and a second double-sided printing mode to print on both surfaces of the print medium using a path different from that used in the first double-sided printing mode, comprising:

receiving means for receiving image data to be printed on the print medium; and converting means for converting the received image data to be printed on the print medium into print image data used in the printing apparatus, wherein the converting means converts the image data so that an amount of ink applied to the print medium when the first double-sided printing mode is executed differs from that when the second double-sided printing mode is executed.

7. An ink jet print method using a print head having print elements to eject ink to print an image on a print medium, comprising the steps of:

selecting one printing mode from a plurality of printing modes, the printing modes including a first double-sided printing mode capable of printing on both surfaces of the print medium and a second double-sided printing mode capable of printing on both surfaces of the printing medium through a path different from that used in the first double-sided printing mode;

converting image data to be printed into print image data to be used by a printing apparatus for printing according to the printing mode selected in the selecting step; and printing on the print medium with the print head according to the print image data generated in the converting step, wherein the convening step performs the data conversion so that an amount of ink applied to the print medium when the first double-sided printing mode is executed differs from that when the second double-sided printing mode is executed.

8. An ink jet print method according to claim 7, wherein the first double-sided printing mode performs an automatic double-sided printing in which, after a printing operation is carried out on one surface of the print medium, the print medium is turned over automatically in the printing apparatus without discharging the print medium, and then the printing operation is carried out on another surface of the print medium, and wherein the second double-sided printing mode performs a manual double-sided printing in which, after a printing operation is carried out on the one surface of the print medium, the print medium is discharged from the printing apparatus, and then the printing operation is carried out on the other surface of the print medium supplied into the printing apparatus by a user.

9. An ink jet print system using a print head having print elements to eject ink to print an image on a print medium, comprising:

print image data generation means to convert image data to be printed into print image data printable by the print head;

first print medium transport means to transport the print medium for printing; and second print medium transport means to transport the print medium through a path different from that used by the first print medium transport means, wherein the print image data generation means generates the print image data by one method when the first print medium transport means is used and by another method when the second print medium transport means is used.

10. An ink jet print method to print an image on a print medium by a print head having print elements to eject ink, comprising the steps of:

deciding which of a plurality of print medium transport sections, capable of transporting the print medium through different paths in the process of printing on the print medium, is to be operated;

converting image data to be printed into print image data to be used by a printing apparatus to print according to the print medium transport sections determined in the deciding step; and printing on the print medium with the print head according to the print image data generated in the converting step, wherein the converting step performs the data conversion so that an amount of ink applied to the print medium is adjusted in accordance with the selected print medium transport section.

* * * * *

UNITED STATES PATENT AND TRADEMARK OFFICE

CERTIFICATE OF CORRECTION

PATENT NO. : 7,185,962 B2
APPLICATION NO. : 10/909283
DATED : March 6, 2007
INVENTOR(S) : Takahashi et al.

It is certified that error appears in the above-identified patent and that said Letters Patent is hereby corrected as shown below:

ON THE TITLE PAGE:
At Item (54), Title, "INK JET APPARATUS" should read --INK JET PRINT APPARATUS--.

COLUMN 1:
Line 1, "INK JET APPARATUS" should read --INK JET PRINT APPARATUS--.
Line 12, "Descrption" should read --Description--.
Line 28, "facsimiles," should read --facsimile machines,--.

COLUMN 2:
Line 14, "contract curling the paper." should read --contract, causing the paper to curl.--.

COLUMN 3:
Line 44, "It is also" should be deleted.
Line 45, "further object of this invention to" should read --This invention can also--.
Line 48, "would be" should read --is--.
Line 52, "comprising;" should read --comprising:--.

COLUMN 4:
Line 1, "to" should be deleted.
Line 17, "including;" should read --including:--.

COLUMN 5:
Line 18, "ink to," should read --ink,--.

COLUMN 6:
Line 1, "cross section" should read --cross-section--.
Line 25, "integral" should read --integrally--.

UNITED STATES PATENT AND TRADEMARK OFFICE

CERTIFICATE OF CORRECTION

PATENT NO. : 7,185,962 B2
APPLICATION NO. : 10/909283
DATED : March 6, 2007
INVENTOR(S) : Takahashi et al.

It is certified that error appears in the above-identified patent and that said Letters Patent is hereby corrected as shown below:

COLUMN 7:
Line 2, “not” should read --(not--.
Line 3, “shown” should read --shown)--.
Line 32, “80” should be deleted.
Line 41, “not shown.” should read --(not shown).--.

COLUMN 9:
Line 45, “ink” should read --inks--.
Line 50, “integral” should read --integrally--.

COLUMN 10:
Line 39, “other colorants than” should read --colorants other than--.
Line 49, “The most” should read --A major--.
Line 62, “other steps than” should read --steps other than--.

COLUMN 13:
Line 12, “reflects” should read --reflect--.

COLUMN 14:
Line 44, “are” should read --is--.

COLUMN 15:
Line 6, “path” should read --paths--.

COLUMN 16:
Line 14, “integral” should read --integrally--.
Line 21, “facsimile).” should read --facsimile machine).--.
Line 31, “example” should read --example,--.
Line 50, “aspect,” should read --aspects,--.
Line 51, “in the apparent claims to” should read --that the appended claims--.

UNITED STATES PATENT AND TRADEMARK OFFICE

CERTIFICATE OF CORRECTION

PATENT NO. : 7,185,962 B2
APPLICATION NO. : 10/909283
DATED : March 6, 2007
INVENTOR(S) : Takahashi et al.

It is certified that error appears in the above-identified patent and that said Letters Patent is hereby corrected as shown below:

COLUMN 17:
Line 33, "convening" should read --converting--.

Signed and Sealed this

Third Day of March, 2009

JOHN DOLL
*Acting Director of the United States Patent and Trademark Office*